US007017986B2

(12) United States Patent
Degen et al.

(10) Patent No.: US 7,017,986 B2
(45) Date of Patent: Mar. 28, 2006

(54) FOLDING CHAIR

(75) Inventors: Jin Degen, Xiamen (CN); Jin Shenghao, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/703,117

(22) Filed: Nov. 6, 2003

(65) Prior Publication Data

US 2004/0251718 A1 Dec. 16, 2004

(30) Foreign Application Priority Data

Nov. 7, 2002 (CN) ..... 02270728 U

(51) Int. Cl.
*A47C 4/00* (2006.01)

(52) U.S. Cl. ..... 297/58; 297/447.2; 297/451.11

(58) Field of Classification Search ..... 297/58, 297/452.18, 447.2, 451.11
See application file for complete search history.

(56) References Cited

U.S. PATENT DOCUMENTS

| | | | | |
|---|---|---|---|---|
| 1,900,486 | A | 3/1933 | Clarin | |
| 1,948,216 | A * | 2/1934 | Gillette | 297/58 |
| D107,545 | S | 12/1937 | O'Conner | |
| D118,185 | S | 12/1939 | Bond | |
| 2,364,093 | A * | 12/1944 | O'Connor | 297/452.21 |
| 2,390,878 | A | 12/1945 | Greitzer | |
| 2,564,924 | A | 8/1951 | Patton | |
| 2,620,019 | A * | 12/1952 | Merrill et al. | 297/58 |
| 2,865,437 | A | 12/1958 | Shwayder | |
| 3,094,357 | A | 6/1963 | Shwayder | |
| 3,171,691 | A | 3/1965 | Buehrig | |
| 3,431,011 | A | 3/1969 | Poppe et al. | |
| 3,466,084 | A * | 9/1969 | Spilman et al. | 297/58 |
| 3,521,349 | A | 7/1970 | Gehring | |
| 3,669,496 | A | 6/1972 | Chrisholm | |
| 3,695,687 | A | 10/1972 | Uyeda | |
| 3,726,330 | A | 4/1973 | Adler | |
| 3,792,353 | A | 2/1974 | Loika, Jr. | |
| 3,822,084 | A | 7/1974 | Brezosky | |
| 3,857,604 | A | 12/1974 | Scott | |
| 3,907,363 | A * | 9/1975 | Baker et al. | 297/450.1 |
| 4,059,199 | A | 11/1977 | Quaney | |
| 4,076,787 | A | 2/1978 | Ervin et al. | |

(Continued)

FOREIGN PATENT DOCUMENTS

FR 1258788 3/1961

(Continued)

OTHER PUBLICATIONS

Contour Seats, Options & Accessories, 5 pages <http://www.contourseats.com/accessories.html>, Feb. 3, 1999.

(Continued)

*Primary Examiner*—Rodney B. White
*Assistant Examiner*—Joe Edell
(74) *Attorney, Agent, or Firm*—Workman Nydegger

(57) ABSTRACT

A folding chair is provided having a first front leg, a second front leg, a first rear leg, a second rear leg, a first link, a second link, a chair seat, and a backrest. The chair seat includes a seat member, a first support bracket, a second support bracket, and a cross-bar connecting the first and second support brackets. The first front leg, the first rear leg, the first link, and the first support bracket form a first four-bar linkage. The second front leg, the second rear leg, the second like, and the second support bracket form a second four-bar linkage.

18 Claims, 4 Drawing Sheets

U.S. PATENT DOCUMENTS

| | | | |
|---|---|---|---|
| 4,092,745 | A | 6/1978 | Oropallo |
| 4,140,236 | A | 2/1979 | Uhlig et al. |
| 4,157,674 | A | 6/1979 | Carlson et al. |
| 4,189,876 | A | 2/1980 | Crossman et al. |
| 4,215,089 | A | 7/1980 | Uhlig et al. |
| 4,223,585 | A | 9/1980 | Barth et al. |
| 4,281,773 | A | 8/1981 | Mengeu |
| 4,415,201 | A | 11/1983 | Wang |
| D274,865 | S | 7/1984 | Murry |
| D274,866 | S | 7/1984 | Murry |
| D274,869 | S | 7/1984 | Aronowitz et al. |
| D277,144 | S | 1/1985 | Murry |
| D277,443 | S | 2/1985 | Murry |
| D279,152 | S | 6/1985 | Murry |
| D279,154 | S | 6/1985 | Aronowitz et al. |
| D279,155 | S | 6/1985 | Aronowitz et al. |
| D279,246 | S | 6/1985 | Murry |
| D279,247 | S | 6/1985 | Murry |
| 4,586,738 | A | 5/1986 | Butler et al. |
| 4,620,330 | A | 11/1986 | Izzi, Sr. |
| 4,671,570 | A | 6/1987 | Hockenberry et al. |
| 4,727,816 | A | 3/1988 | Virtue |
| 4,732,726 | A | 3/1988 | Grannen, III |
| 4,768,825 | A | 9/1988 | Quinlan, Jr. |
| 4,768,833 | A | 9/1988 | Virute |
| 4,826,265 | A | 5/1989 | Hockenberry |
| 4,841,877 | A | 6/1989 | Virtue |
| 4,854,638 | A | 8/1989 | Marcus et al. |
| 4,860,421 | A | 8/1989 | Breda et al. |
| 4,861,100 | A | 8/1989 | Baccaro |
| 4,898,421 | A | 2/1990 | Brunn |
| 4,951,576 | A | 8/1990 | Cobos et al. |
| 4,987,714 | A | 1/1991 | Lemke |
| D314,871 | S | 2/1991 | Goetz |
| 4,995,323 | A | 2/1991 | Kellems et al. |
| 5,078,562 | A | 1/1992 | DeHaitre |
| 5,100,204 | A | 3/1992 | Makihara et al. |
| 5,133,630 | A | 7/1992 | Hughes |
| 5,167,436 | A | 12/1992 | Wu |
| 5,222,850 | A | 6/1993 | Medal |
| 5,244,291 | A | 9/1993 | Confer |
| 5,271,650 | A | 12/1993 | Fukuhara et al. |
| 5,288,453 | A | 2/1994 | Rutenbeck et al. |
| 5,375,914 | A | 12/1994 | Donnelly |
| 5,413,833 | A | 5/1995 | Hernandez et al. |
| 5,443,020 | A | 8/1995 | Price |
| 5,498,045 | A | 3/1996 | Morgan et al. |
| 5,538,680 | A | 7/1996 | Enders |
| 5,542,743 | A | 8/1996 | Olsen et al. |
| 5,582,460 | A | 12/1996 | Schultz |
| 5,593,262 | A | 1/1997 | Gedeon et al. |
| 5,641,035 | A | 6/1997 | Petit |
| 5,671,686 | A | 9/1997 | Hurley et al. |
| 5,679,304 | A | 10/1997 | Watanabe et al. |
| 5,681,078 | A | 10/1997 | Chen |
| 5,694,865 | A | 12/1997 | Raab |
| 5,699,944 | A | 12/1997 | Duran |
| 5,704,750 | A | 1/1998 | Bartos et al. |
| 5,711,576 | A | 1/1998 | Olson et al. |
| 5,718,474 | A | 2/1998 | Kojima et al. |
| 5,730,489 | A | 3/1998 | Eberle et al. |
| 5,735,656 | A | 4/1998 | Marvell et al. |
| 5,749,628 | A | 5/1998 | Synder et al. |
| 5,769,256 | A | 6/1998 | Medal |
| 5,848,718 | A | 12/1998 | Colwell |
| 5,855,409 | A | 1/1999 | Tseng |
| 5,879,115 | A | 3/1999 | Medal |
| 5,951,110 | A | 9/1999 | Conner et al. |
| 5,983,807 | A | 11/1999 | Tarnay et al. |
| D422,805 | S | 4/2000 | Smith |
| 6,068,901 | A | 5/2000 | Medal |
| 6,095,225 | A | 8/2000 | Miller |
| 6,102,156 | A | 8/2000 | Lipniarski |
| D432,805 | S | 10/2000 | Smith |
| 6,126,355 | A | 10/2000 | Clover, Jr. |
| 6,131,992 | A | 10/2000 | Chang |
| D435,977 | S | 1/2001 | Ambasz |
| D436,457 | S | 1/2001 | Ambasz |
| 6,171,041 | B1 | 1/2001 | Bazinski et al. |
| 6,193,307 | B1 | 2/2001 | Lin |
| D443,429 | S | 6/2001 | Mower et al. |
| 6,250,524 | B1 | 6/2001 | Maruyama |
| 6,394,541 | B1 | 5/2002 | Wegner |
| 6,543,842 | B1 | 4/2003 | Haney |
| 6,616,223 | B1 | 9/2003 | Lin |
| 6,669,281 | B1 | 12/2003 | Huang |
| 2001/0033100 | A1* | 10/2001 | Haney ..... 297/55 |
| 2003/0034676 | A1* | 2/2003 | Wen et al. ..... 297/58 |
| 2003/0168894 | A1* | 9/2003 | Lin ..... 297/55 |

FOREIGN PATENT DOCUMENTS

| | | |
|---|---|---|
| GB | 321989 | 11/1929 |
| JP | 06269331 | 9/1994 |
| JP | 08322671 | 12/1996 |
| JP | 08322672 | 12/1996 |

OTHER PUBLICATIONS

Defendant FDL, Inc.'s Answer to Plaintiffs' Complaint and FDL Inc.'s Counterclaim, Apr. 19, 2004, 7 pages.

Defendant FDL, Inc.'s Amended Answer to Plaintiffs' Complaint and FDL Inc.'s Counterclaim, Apr. 20, 2004, 36 pages.

Defendant's Preliminary Response to Plaintiff's Motion for Preliminary Injunction and Motion to Defer Briefin and Permit Expedited Discovery, Mar. 18, 2004, 13 pages.

Appendix of Exhibits A—J in Support of Defendant GSC Technology Corporation's Preliminary Opposition to Lifetime's Motion for Preliminary Injunction, 88 pages.

Defendant's Answer to Plaintiff's Complaint and Counterclaims, Apr. 5, 2004, 39 pages.

US 5,697,774, 12/1997, Medal (withdrawn)

* cited by examiner

FOLDING CHAIR

CROSS-REFERENCE TO RELATED APPLICATIONS

This application claims priority to and benefit of Chinese Patent Application No. 02270728.X, filed Nov. 7, 2002, and entitled "A Type of Folding Chair," which application is incorporated herein by reference in its entirety.

BACKGROUND OF THE INVENTION

1. The Field of the Invention

The present invention is directed to folding chairs.

2. The Relevant Technology

Increasingly high functional requirements are being placed on modem furniture, whether for home or office, in order to make them more practical, comfortable, and convenient. FIG. 5 illustrates a conventional folding chair, illustrating features typical of folding chairs in the industry. The folding chair includes a first leg assembly 1, a second leg assembly 2, a first link 3, a second link 4, a chair seat 5, a support bracket 6, a backrest 7, a right cross-bar 8, and a left cross-bar 9.

The first leg assembly 1 comprises a right front leg 11 and a right rear leg 12. Similarly, the second leg assembly 2 comprises a left front leg 21 and a left rear leg 22. The right front leg 11, the right rear leg 12, the first link 3, and the chair seat 5, form a first four-bar linkage and the left front leg 21, the left rear leg 22, the second link 4, and the chair seat 5, form a second four-bar linkage. During use, the folding chair folds fully.

A first projecting bar 10 and second projecting bar 20 extend outwardly from the right and left side of the support bracket 6. The first link 3 and the second link 4 rest on the first projecting bar 10 and second projecting bar 20 of the Support bracket 6 when the chair is in the use position. Thus, repeated use of the folding chair tends to damage the links 3 and 4, thereby lowering the service life of the folding chair and increasing the difficulty of manufacture.

The chair seat 5 and the support bracket 6 form the seat assembly. The chair seat 5 is set over the support bracket 6. As a result, not only is the seat assembly insufficiently strong, but also the weight of the folding chair is increased. In addition, the top surface of the chair seat 5 and front surface of the backrest 7 are substantially flat. Thus, the user's weight cannot be evenly distributed on the chair seat. Stress tends to concentrate, damaging the chair seat 5 and backrest 7 and thereby reducing the service life of the folding chair.

SUMMARY OF THE INVENTION

The present invention seeks to address the disadvantages found in the prior art by providing a folding chair which is high-strength, comfortable, and of simple manufacturing design, thus reducing the cost of the folding chair while providing the strength necessary to support a person thereon.

In one aspect of the invention, a folding chair is provided having a first front leg; a first rear leg; a first link pivotally connected to the first front leg and the first rear leg; a first support bracket pivotally connected to the first front leg and the first rear leg, the first front leg, first rear leg, first link and first support bracket forming a four-bar, four pivot linkage that allows the folding chair to be moved between a use position and a storage position, wherein the first support bracket comprises a lateral portion and a bottom portion.

The folding chair may also have a second front leg; a second rear leg; a second link pivotally connected to the second front leg and the second rear leg; a second support bracket pivotally connected to the second front leg and the second rear leg, the second front leg, the second rear leg, the second link and the second support bracket forming a four-bar, four-pivot linkage that allows the folding chair to be moved between a use position and a storage position, wherein the second support bracket comprises a lateral portion and a bottom portion.

The chair may also have a blow molded seat member connected to the first support bracket and the second support bracket, the blow molded seat member including an upper surface and a lower surface generally spaced apart from the upper surface and extending between a first edge and a second edge, wherein a first attachment recess and second attachment recess are formed on the seat member, the first attachment recess comprising a lateral portion formed on the first edge and a bottom portion formed on the lower surface of the seat member, the second attachment recess comprising a lateral portion formed on the second edge and a bottom portion formed on the lower surface of the seat member, wherein the lateral portion of the first support bracket is fixedly secured to the lateral portion of the first attachment recess, and the bottom portion of the first support bracket is fixedly secured to the bottom portion of the first attachment recess, and wherein the lateral portion of the second support bracket is fixedly secured to the lateral portion of the second attachment recess, and the bottom portion of the second support bracket is fixedly secured to the bottom portion of the second attachment recess.

The upper surface of the seat member may have a slightly curved surface. The lower surface of the seat member may have a plurality of grooves.

A cross-bar may be disposed transversely to the first support member and the second support member and coupled therebetween.

The first attachment recess and second attachment recess may further include slots formed at opposing ends of the bottom portion extending inwardly from the lower surface of the seat member. Additionally, the first support member and the second support member may include flanges disposed at opposing ends of the bottom portion, wherein the flanges are configured to be disposed in the slots of the first attachment recess and second attachment recess.

The first front leg and the second front leg may be connected by a front support bar, in one embodiment, forming a substantially U-shaped structure. Similarly, the first rear leg and the second rear leg are connected by a rear support bar, in one embodiment, forming a substantially U-shaped structure.

The folding chair may also include a blown-molded backrest having a front surface and a rear surface generally spaced apart from the front surface, the backrest being configured to be connect to both an upper portion of the first front leg and an upper portion of the second front leg. The back rest may include apertures formed on a bottom surface thereof so that the back rest can form a press-fit connection with the upper portions of the first front leg and the second front leg. The front surface of the back rest may have a slightly curved surface.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

Figure 1:
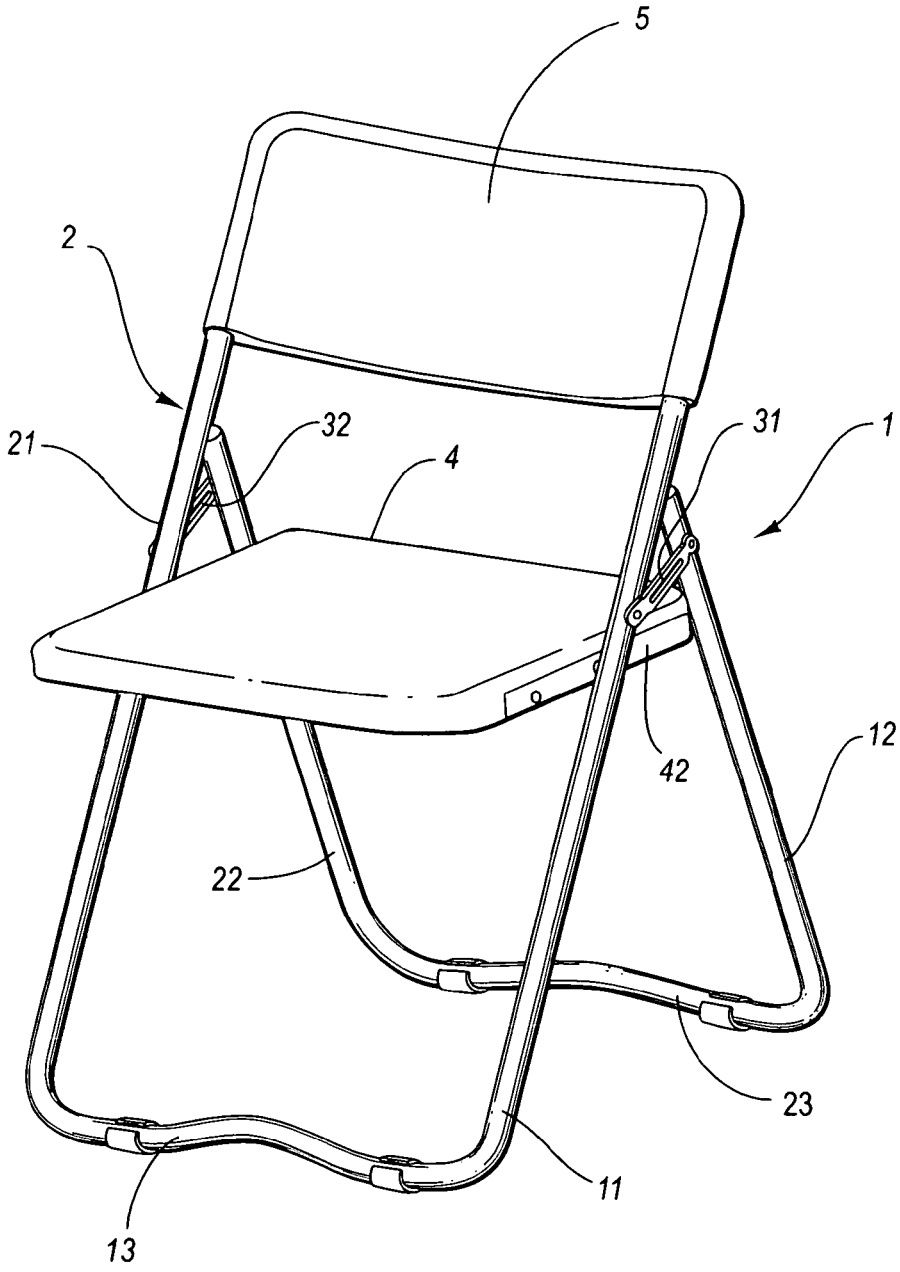
FIG. 1 illustrates a perspective view of a folding chair according to one embodiment of the present invention.
Figure 2:
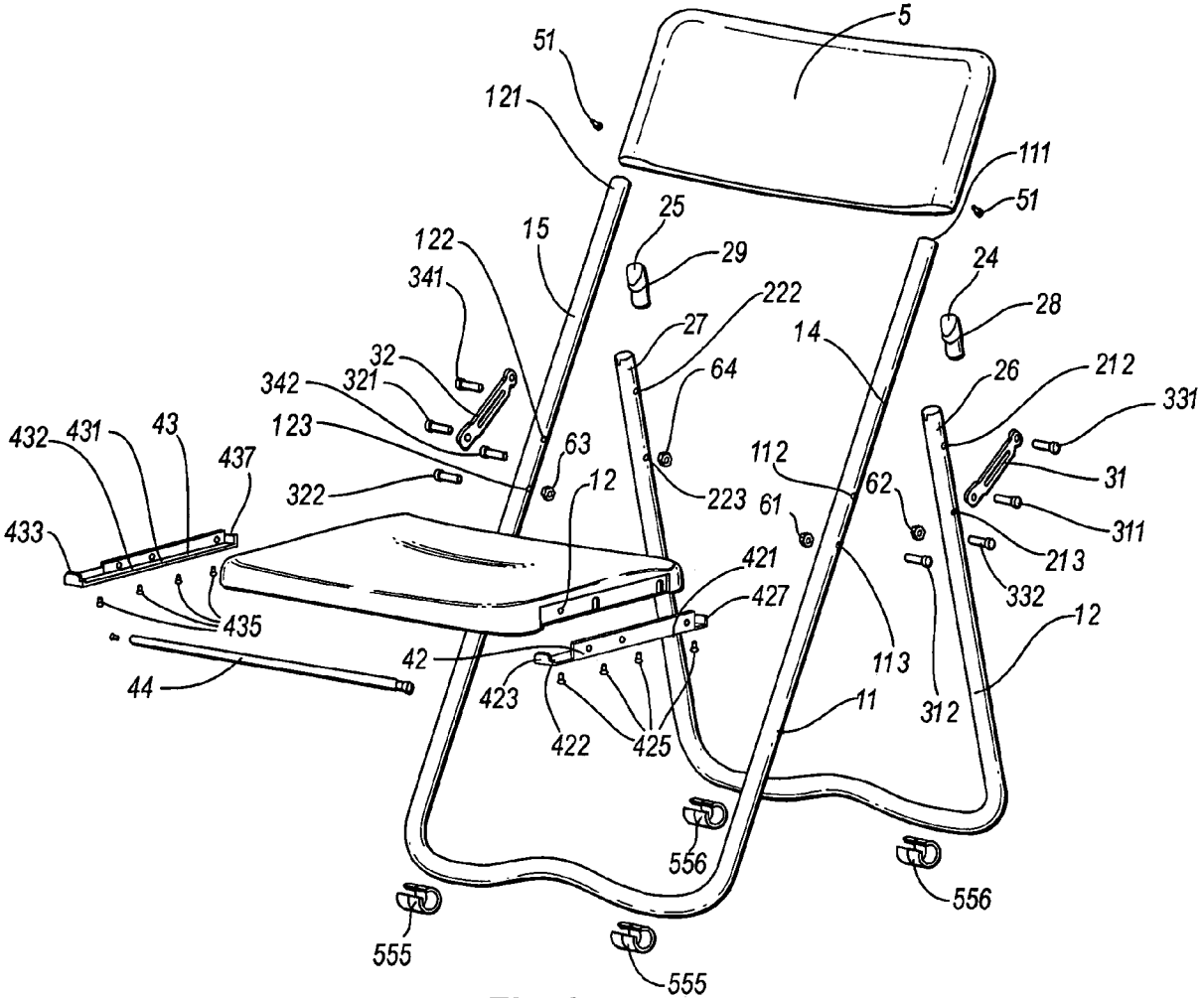
FIG. 2 is an exploded view of the folding chair of FIG. 1, illustrated in an unfolded or functional position.
Figure 3:
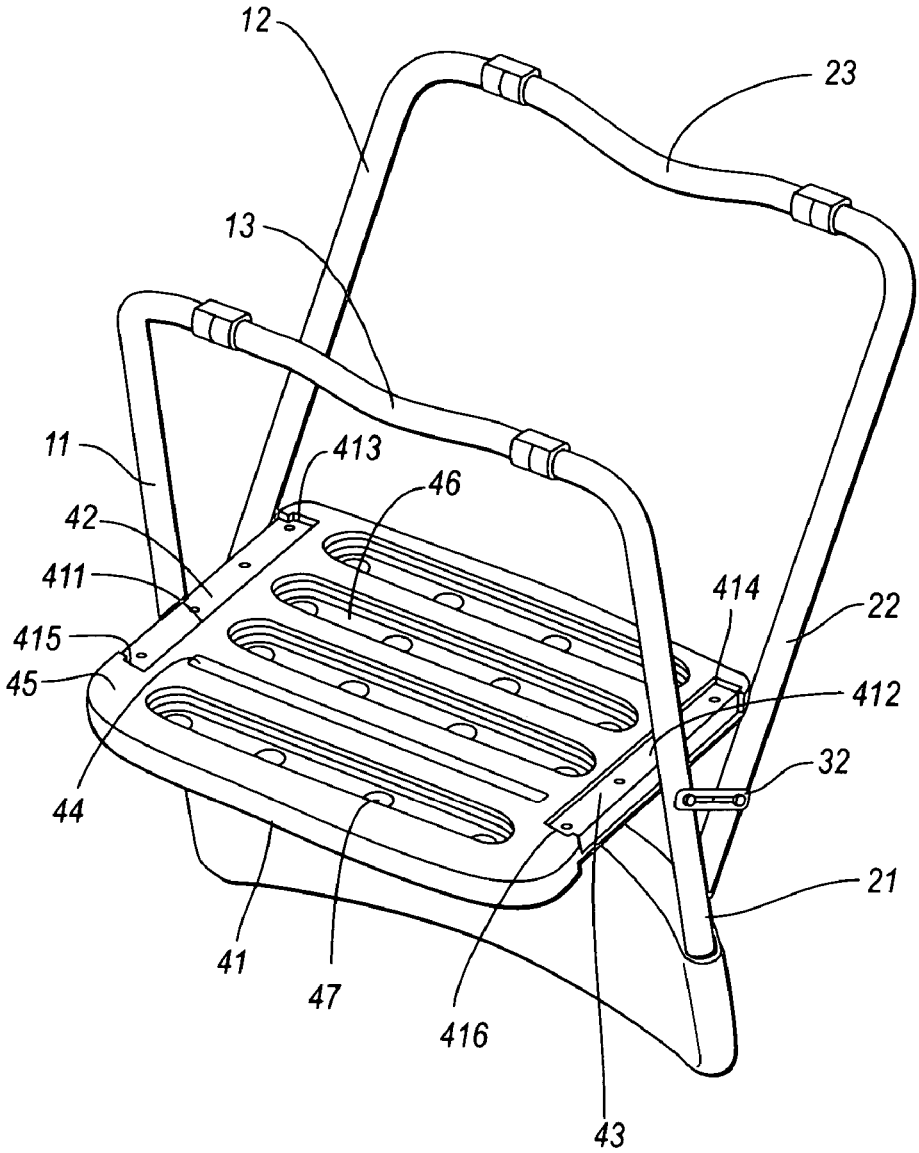
FIG. 3 is a perspective view of the folding chair of FIG. 1, viewing the chair from the underside position.
Figure 4:
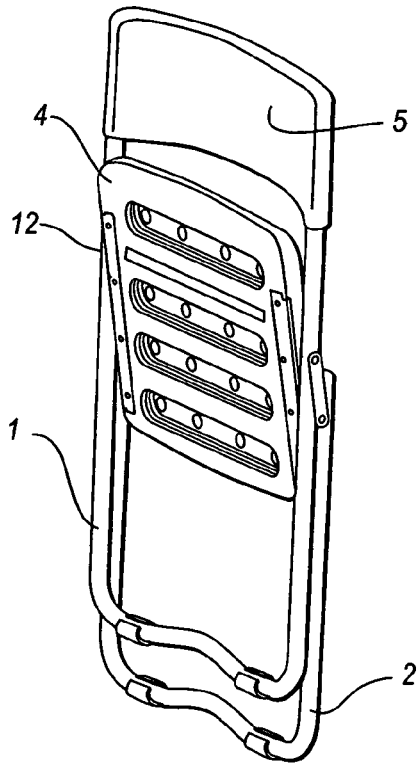
FIG. 4 is a perspective view of the folding chair of FIG. 1, illustrated in a folded position.
Figure 5:
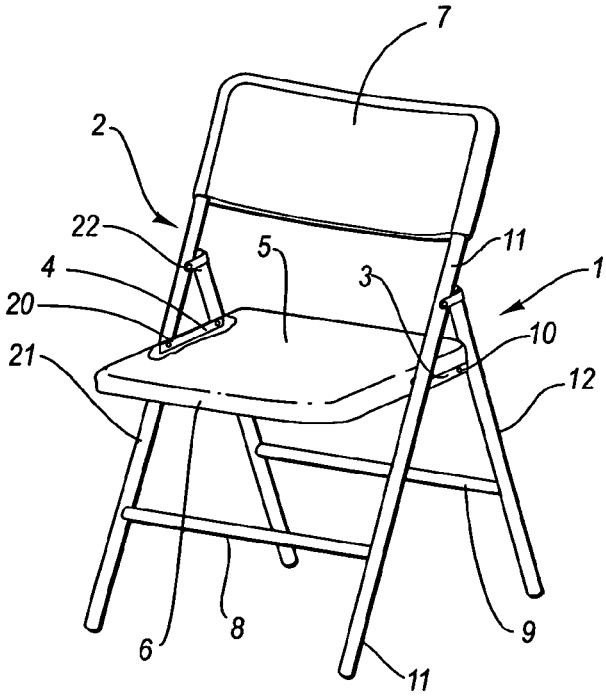
FIG. 5 is a conventional folding chair.

FIGS. 1 through 4 illustrate an exemplary folding chair incorporating features of the present invention. First, with reference to FIG. 1, the folding chair includes a front support frame 1, a rear support frame 2, a first link 31, and second link 32, a chair seat 4, and a backrest 5. The folding chair is selectively positionable between a functional or unfolded position (FIG. 1) and a storage or folded position (FIG. 4). The chair seat 4 comprises a seat member 41, a first support bracket 42, and a second support bracket 43.

The front support frame 1 comprises a right front leg 11 and a left front leg 21. A front base bar 13 joins the right front leg 11 and the left front leg 21. As such, the right front leg 11, left front leg 21 and front base bar 13 form a substantially U-shaped member. The front base bar 13 is curved, and there are two bases 555 located thereon. However, the front base bar 13 can be disposed at any location along the length of right front leg 11 and left front leg 21 below the chair seat 4 to provide strength therebetween. Likewise, the rear support frame 2 comprises a right rear leg 12 and left rear leg 22. A rear base bar 23 joins the right rear leg 12 and the left rear leg 22. As such, the right rear leg 12, left rear leg 22, and rear base bar 23 forms a substantially U-shaped member. The rear base bar 23 is curved, and there are two bases 556 located thereon. However, the rear base bar 23 can be disposed at any location along the length of right rear leg 12 and left rear leg 22 below the chair seat 4 to provide strength therebetween.

The front support frame 1 and the rear support frame 2 are preferably hollow structures. This type of structure, in addition to reducing the weight of the folding chair, increases its rigidity and resistance to bending.

With reference now to FIG. 2, the right front leg 11 has a first upper terminal point 111. There are two holes, 112 and 113, exposed outwardly in the mid-section thereof. Hole 112 is the location where the first link 31 and the right front leg 11 are pivotally coupled by means of a rivet 311. Hole 113 is the location where the first support bracket 42 and the right front leg 11 are pivotally coupled by means of a rivet 312. The left front leg 21 has a second terminal point 121. There are two holes, 122 and 123, exposed outwardly in the mid-section thereof. Hole 122 is the location where the second link 32 and the left front leg 21 are pivotally coupled by means of a rivet 321. Hole 123 is the location where the second support bracket 43 and the left front leg 21 are pivotally coupled by means of a rivet 322.

The right rear leg 12 extends upwardly, where there is a third terminal point 26. A first end cap 28 is disposed at the top end of the right rear leg 12. There are two holes 212 and 213 exposed outwardly and formed at an end thereof. Hole 212 is the location where the first link 31 and the right rear leg 12 are pivotally coupled by means of a rivet 331. Hole 213 is the location where the first support bracket 42 and the right rear leg 12 are pivotally coupled by means of a rivet 332.

The left rear leg 22 extends upwardly, where there is a fourth terminal point 27. A second end cap 29 is disposed at the top end of the left rear leg 22. There are two holes 222 and 223 exposed outwardly and formed at an end thereat. Hole 222 is the location where the second link 32 and the left rear leg 22 are pivotally coupled by means of a rivet 341. Hole 223 is the location where the second support bracket 43 and the left rear leg 22 are pivotally coupled by means of a rivet 342.

The first link 31 is pivotally connected to the right front leg 11 and the right rear leg 12 at holes 112 and 212, respectively. The first support bracket 43 is pivotally connected to the right front leg 11 and the right rear leg 12 at holes 113 and 213. respectively. The pivot connections at holes 112, 212, 113 and 213, thus form a foldable four-bar linkage. When the chair is in the use or unfolded position, the outer side 14 of the central part of the right front leg 11 rests on the upper end 24 of the first end cap 28 of the right rear leg 12.

Likewise, the second link 32 is pivotally connected to the left front leg 21 and the left rear leg 22 at holes 122 and 222, respectively. Further, the second support bracket 43 is pivotally connected to the left front leg 21 and the left rear leg 22 at holes 123 and 223, respectively. The pivot connection at holes 122, 222, 123 and 223 thus form a foldable four-bar linkage. When the chair is in the use or unfolded position, the outer side 15 of the central part of the left front leg 21 rests on the upper end 25 of the second end cap 29 of the left rear leg 22.

Washers 61, 62, 63 and 64 are disposed between chair seat 4 and front support frame 1 and the rear support frame 2. The washers restrict movement in the left and right directions of the chair seat 4 relative to the front support frame 1 and rear support frame 2. In addition, they facilitate rotation of the chair seat 4 relative to the front support frame 1.

FIG. 3 shows a perspective view of the chair viewing the chair from underneath the chair seat 4. The chair seat 4 comprises a light-weight seat member 41, a first support bracket 42, a second support bracket 43, and a cross-bar 44. The chair seat 4 is positioned between the right front and rear legs 11, 12 and the left front and rear legs 21, 22.

In one embodiment, the seat member 41 is a blow-molded, hollow, plastic structure. The seat member 41 includes an upper surface and a lower surface 45. The outer contour of the upper surface of the seat member 41 is preferably curved. In addition, the upper surface is slightly concave towards the center of the seat member 41. Thus, it provides a comfortable seating surface. In addition, the lower surface 45 of the seat member 41 has four grooves 46 and many recesses 47 that are slightly concave towards the center of the seat member 41. The grooves 46 and recesses 47 can increase the resistance of the seat member 41 to bending and evenly distribute the weight of the user when sitting thereon. In addition, the grooves 46 enable the user to grasp the chair seat 4 easily when folding.

On the lower surface 45 of the seat member 41, a first attachment recess 411 and second attachment recess 412 are formed on the right and left side, respectively. In addition, at each end of the ridges 411, 412, are formed slots 413, 414, 415 and 416 which extend into the seat member 41. The first support bracket 42 and second support bracket 43 is disposed in the first attachment recess 411 and second attachment recess 412, respectively.

As shown in FIG. 2, the first support bracket 42 is L-shaped. Support bracket 42 includes a first lateral side 421, a first bottom side 422, a first flange 423, and a second flange 427. When disposed in the first attachment recess 411 of the seat member 41, the first flange 423 and the second flange 427 are inserted into the first slot 413 and the second slot 415. The first lateral side 421 and the first bottom side 422 are then secured to the first attachment recess 411 using rivets 425.

Similarly, the second support bracket 43 is L-shaped. The second support bracket 43 includes a second lateral side 431, a second bottom side 432, a third flange 433, and a fourth flange 437. When disposed in the second attachment recess 412 of the seat member 41, the two second flanges 433 and 437 are inserted into the third slot 414 and the fourth slot 416, respectively. The second lateral side 431 and the second bottom side 432 are then secured to the second attachment recess 412 using rivets 435. The first support bracket 42 and the second support bracket 43 fix the movement relative to the seat member 41 and evenly distribute the weight of the user on the seat member while also reducing the weight of the folding chair.

A cross-bar 44 passes through the seat member 41, providing a connection between the first support bracket 42 and the second support bracket 43 and thus creates an H-shape support structure. The cross-bar 44 fixes the movement of the seat member 41 relative to the first support bracket 42 and the second support bracket 43. The use of the cross-bar 44 strengthens the seat member 41, causing the stress in chair seat 4 to be distributed and reducing the tendency of breakage or weakening at the connections between the front support frame 1, the rear support frame 2, the first support bracket 42, and the second support bracket 43. Thus, it extends the service life of the folding chair.

In one embodiment, the backrest 5 is a hollow, blow-molded plastic structure. Preferably, the backrest 5 is curved, concave toward the front of the chair, providing a comfortable structure for users to rest against. The backrest 5 is positioned on the first upper terminal point 111 of the right front leg 11 and the second upper terminal point 121 of the left front leg 21. The backrest 5 contains apertures at the ends of a bottom surface, which apertures are configured to receive the ends 111, 121 of right front leg 11 and left front leg 21. Preferably, the backrest 5 can be press-fit onto the front support frame 1. In addition, the backrest 5 can be secured thereto with two rivets 51.

The chair is selectively foldable between a use position (FIG. 1) and a storage position (FIG. 4). When folded, the front support frame 1 and the rear support frame 2 are parallel to each other. The seat 4 is also substantially parallel to the back rest 5. This folding structure is easy to fold, extremely compact, and does not cause undue stress on the connections between the front support frame 1, the rear support frame 2, and the chair seat 4.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A folding chair comprising:

a first front leg;

a first rear leg;

a first link pivotally connected to the first front leg and the first rear leg;

a first support bracket pivotally connected to the first front leg and the first rear leg, the first support bracket including a first end, an opposing second end, a first side and a second side, the first support bracket including a first lateral portion, a first bottom portion, a first inwardly extending flange disposed generally proximate the first end of the first support bracket and extending generally upwardly from the first bottom portion of the first support bracket, the first flange including a width generally equal to a width of the first bottom portion of the first support bracket, a second inwardly extending flange disposed generally proximate the second end of the first support bracket and extending generally upwardly from the first bottom portion of the first support bracket, the second flange including a width generally equal to the width of the first bottom portion of the first support bracket;

a first four-bar, four pivot linkage at least partially formed by the first front leg, the first rear leg, the first link and the first support bracket, the first four-bar, four pivot linkage being sized and configured to allow the folding chair to be moved between a use position and a storage position;

a second front leg;

a second rear leg;

a second link pivotally connected to the second front leg and the second rear leg;

a second support bracket pivotally connected to the second front leg and the second rear leg, the second support bracket including a first end, an opposing second end, a first side and a second side, the second support bracket including a second lateral portion, a second bottom portion, a first inwardly extending flange disposed generally proximate the first end of the second support bracket and extending generally upwardly from the second bottom portion of the second support bracket, the second flange including a width generally equal to a width of the second bottom portion of the second support bracket, and a second inwardly extending flange disposed generally proximate the second end of the second support bracket and extending generally upwardly from the second bottom portion of the second support bracket, the second flange including a width generally equal to the width of the second bottom portion of the second support bracket;

a second four-bar, four pivot linkage at least partially formed by the second front leg, the second rear leg, the second link and the second support bracket, the second four-bar, four pivot linkage being sized and configured to allow the folding chair to be moved between a use position and a storage position a blow molded seat member connected to the first support bracket and the second support bracket, the blow molded seat member including an upper surface and a lower surface generally spaced apart from the upper surface and extending between a first edge and a second edge;

a first attachment recess formed on the seat member and including, a first lateral extending portion formed on the first edge and a first bottom extending portion formed on the lower surface of the seat member, the first attachment recess including a first slot disposed generally proximate a first end of the first bottom extending portion and extending inwardly from the lower surface of the seat member, the first attachment recess including a second slot disposed generally proximate a second end of the first bottom extending portion and extending inwardly from the lower surface of the seat member;

a second attachment recess formed on the seat member and including a second lateral extending portion formed on the second edge and a second bottom extending portion formed on the lower surface of the seat member, the second attachment recess including a first slot disposed generally proximate a first end of the first bottom extending portion and extending inwardly from the lower surface of the seat member, the second attachment recess including a second slot disposed generally proximate a second end of the first bottom extending portion and extending inwardly from the lower surface of the seat member;

wherein the first lateral portion of the first support bracket is fixedly secured relative to the first lateral extending portion of the first attachment recess, and the first bottom portion of the first support bracket is fixedly secured relative to the first bottom extending portion of the first attachment recess with the first inwardly extending flange at least partially disposed in the first slot and the second inwardly extending flange at least partially disposed in the second slot; and wherein the second lateral portion of the second support bracket is fixedly secured relative to the second lateral extending portion of the second attachment recess, and the second bottom portion of the second support bracket is fixedly secured relative to the second bottom extending portion of the second attachment recess with the first inwardly extending flange at least partially disposed in the first slot and the second inwardly extending flange at least partially disposed in the second slot.

2. The folding chair as recited in claim 1, wherein the upper surface of the seat member comprises a slightly curved surface.

3. The folding chair as recited in claim 1, wherein the lower surface of the seat member comprises a plurality of grooves.

4. The folding chair as recited in claim 1, further comprising a cross-bar disposed transversely to the first support member and the second support member and coupled therebetween.

5. The folding chair as recited in claim 1, wherein the first front leg and the second front leg are connected by a front support bar.

6. The folding chair as recited in claim 5, wherein the first front leg, the second front leg, and the front support bar form a substantially U-shaped structure.

7. The folding chair as recited in claim 1, wherein the first rear leg and the second rear leg are connected by a rear support bar.

8. The folding chair as recited in claim 7, wherein the first rear leg, the second rear leg, and the rear support bar form a substantially U-shaped structure.

9. The folding chair as recited in claim 1, further comprising a blow-molded backrest having a front surface and a rear surface generally spaced apart from the front surface, the backrest being configured to be connect to both an upper portion of the first front leg and an upper portion of the second front leg.

10. The folding chair as recited in claim 9, wherein the back rest comprises apertures formed on a bottom surface thereof so that the back rest can form a press-fit connection with the upper portions of the first front leg and the second front leg.

11. The folding chair as recited in claim 9, wherein the front surface of the backrest comprises a slightly curved surface.

12. A folding chair comprising:

a first front leg;

a first rear leg;

a first link pivotally connected to the first front leg and the first rear leg;

a first support bracket pivotally connected to the first front leg and the first rear leg, the first front leg, first rear leg, first link and first support bracket forming a first four-bar, four pivot linkage that allows the folding chair to be moved between a use position and a storage position, the first support bracket including a first lateral portion and a first bottom portion, the first support bracket including a first end, an opposing second end, a first side and a second side, the first support bracket including a first flange disposed generally proximate the first end, the first flange including a width generally equal to a width of the first bottom portion, the first support bracket including a second flange disposed generally proximate the second end, the second flange including a width generally equal to the width of the first bottom portion;

a second front leg;

a second rear leg;

a second link pivotally connected to the second front leg and the second rear leg;

a second support bracket pivotally connected to the second front leg and the second rear leg, the second front leg, the second rear leg, the second link and the second support bracket forming a second four-bar, four-pivot linkage that allows the folding chair to be moved between a use position and a storage position, the second support bracket including a second lateral portion and a second bottom portion, the second support bracket including a first end, an opposing second end, a first side and a second side, the second support bracket including a first flange disposed generally proximate the first end, the first flange including a width generally equal to a width of the second bottom portion, the second support bracket including a second flange disposed generally proximate the second end, the second flange including a width generally equal to the width of the second bottom portion;

a blow molded seat member connected to the first support bracket and the second support bracket, the blow molded seat member including an upper surface and a generally spaced apart lower surface;

a first attachment recess integrally formed in the blow molded seat member as part of a unitary, one-piece construction, the first attachment recess including a first generally lateral extending portion, a first generally horizontal extending portion, a first receiving portion that is sized and configured to at least partially receive the first flange of the first support bracket and a second receiving portion that is sized and configured to at least partially receive the second flange of the first support bracket to facilitate attachment of the first support bracket to the seat member;

a second attachment recess integrally formed in the blow molded seat member as part of a unitary, one-piece construction, the second attachment recess including a second generally lateral extending portion, a second generally horizontal extending portion a first receiving portion that is sized and configured to at least partially receive the first flange of the second support bracket and a second receiving portion that is sized and configured to at least partially receive the second flange of the second support bracket to facilitate attachment of the second support bracket to the seat member.

13. The folding chair as recited in claim 12, further comprising a cross-bar coupled to and disposed between the first support bracket and the second support bracket.

14. The folding chair as recited in claim 12, further comprising a blow-molded backrest having a front surface and a rear surface generally spaced apart from the front surface, the backrest being configured to be connected to both an upper portion of the first front leg and an upper portion of the second front leg.

15. The folding chair as recited in claim 14, wherein the backrest includes a first aperture that is sized and configured to receive a portion of the first front leg and a second aperture that is sized and configured to receive a portion of the second front leg.

16. A folding chair comprising:

a first front leg;

a first rear leg;

a first link pivotally connected to the first front leg and the first rear leg;

a first support bracket pivotally connected to the first front leg and the first rear leg, the first front leg, first rear leg, first link and first support bracket forming a first four-bar, four pivot linkage that allows the folding chair to be moved between a use position and a storage position, the first support bracket including a first lateral portion, a first bottom portion, a first end, a second end, a first side, a second side, a first projection disposed generally proximate the first end and a second projection disposed generally proximate the second end, the first projection and the second projection including a width generally equal to a width of the first bottom portion;

a second front leg;

a second rear leg;

a second link pivotally connected to the second front leg and the second rear leg;

a second support bracket pivotally connected to the second front leg and the second rear leg, the second front leg, the second rear leg, the second link and the second support bracket forming a second four-bar, four-pivot linkage that allows the folding chair to be moved between a use position and a storage position, the second support bracket including a second lateral portion, a second bottom portion, a first end, a second end, a first side, a second side, a first projection disposed generally proximate the first end and a second projection disposed generally proximate the second end, the first projection and the second projection including a width generally equal to a width of the second bottom portion;

a blow molded seat member including an upper surface and a generally spaced apart lower surface, the blow molded seat member including a first attachment portion including a first lateral extending portion and a first bottom extending portion, the blow molded seat member including a second attachment portion including a second lateral extending portion and a second bottom extending portion, the blow molded seat member comprising:

a first set of receiving portions integrally formed in the blow molded seat member as part of a unitary, one-piece structure, the first set of receiving portion being sized and configured to receive the first projection and the second projection of the first support bracket when the first support bracket is connected to the seat member; and a second set of receiving portions integrally formed in the blow molded seat member as part of a unitary, one-piece structure, the first set of receiving portion being sized and configured to receive the first projection and the second projection of the second support bracket when the second support bracket is connected to the seat member.

17. The folding chair as recited in claim 16, wherein the first set of projections are configured to be disposed in the first set of apertures of the first attachment recess and the second set of projections are configured to be disposed in the second set of apertures of the second attachment recess.

18. A folding chair comprising:

a first front leg;

a first rear leg;

a first link pivotally connected to the first front leg and the first rear leg;

a first support bracket generally elongated between a first end and a second end and pivotally connected to the first front leg and the first rear leg, the first front leg, first rear leg, first link and first support bracket forming a first four-bar, four pivot linkage that allows the folding chair to be moved between a use position and a storage position, the first support bracket including a first generally inwardly extending projection disposed proximate the first end of the first support bracket and a second generally inwardly extending projection disposed proximate the second end of the first support bracket, the first projection and the second projection having a width generally equal to a width of the first support bracket;

a second front leg;

a second rear leg;

a second link pivotally connected to the second front leg and the second rear leg;

a second support bracket generally elongated between a first end and a second end and pivotally connected to the second front leg and the second rear leg, the second front leg, the second rear leg, the second link and the second support bracket forming a second four-bar, four-pivot linkage that allows the folding chair to be moved between a use position and a storage position, the second support bracket including a first generally inwardly extending projection disposed proximate the first end of the second support bracket and a second generally inwardly extending projection disposed proximate the second end of the second support bracket, the first projection and the second projection having a width generally equal to a width of the second support bracket;

a blow molded seat member including an upper surface and a generally spaced apart lower surface, the blow molded seat member including a first side and a second side, the first side of the blow molded seat member including a first receiving portion that is sized and configured to receive at least a portion of the first generally inwardly extending projection disposed proximate the first end of the first support bracket and a second receiving portion that is sized and configured to receive at least a portion of the second generally inwardly extending projection disposed proximate the second end of the first support bracket, the second side of the blow molded seat member including a first receiving portion that is sized and configured to receive at least a portion of the first generally inwardly extending projection disposed proximate the first end of the second support bracket and a second receiving portion that is sized and configured to receive at least a portion of the second generally inwardly extending projection disposed proximate the second end of the second support bracket.

* * * * *

UNITED STATES PATENT AND TRADEMARK OFFICE

CERTIFICATE OF CORRECTION

PATENT NO. : 7,017,986 B2
APPLICATION NO. : 10/703117
DATED : March 28, 2006
INVENTOR(S) : Degen et al.

It is certified that error appears in the above-identified patent and that said Letters Patent is hereby corrected as shown below:

Title Page
Item 30, Foreign Application Priority Data, change "02270728 U" to --02270728 X--
Item 56, References Cited, U.S. Patent Documents, Patent 3,669,496, change "Chrisholm" to --Chisholm--
Item 56, References Cited, Other Publications, 4th reference, After "Defendant's Preliminary Response to Plaintiff's Motion for Preliminary Injunction and Motion to Defer" change "Briefin" to --Briefing--

Column 1
Line 17, change "modem" to --modern--
Line 37, change "Support" to --support--

Column 2
Line 54, change "blown-molded" to --blow-molded--
Line 62, change "back rest" to --backrest--

Column 3
Line 47, change "forms" to --form--

Column 4
Line 36, change "connection" to --connections--

Column 5
Line 6, change "is" to --are--
Line 22, remove "second"

UNITED STATES PATENT AND TRADEMARK OFFICE

CERTIFICATE OF CORRECTION

PATENT NO. : 7,017,986 B2
APPLICATION NO. : 10/703117
DATED : March 28, 2006
INVENTOR(S) : Degen et al.

It is certified that error appears in the above-identified patent and that said Letters Patent is hereby corrected as shown below:

Column 10
Line 8, change "portion" to --portions--
Line 15, change "portion" to --portions--

Signed and Sealed this

Twenty-first Day of November, 2006

JON W. DUDAS
*Director of the United States Patent and Trademark Office*